US009265988B2

(12) United States Patent
van der Merwe

(10) Patent No.: US 9,265,988 B2
(45) Date of Patent: Feb. 23, 2016

(54) EXERCISE APPARATUS

(76) Inventor: Willem Mare van der Merwe, Newlands (ZA)

( * ) Notice: Subject to any disclaimer, the term of this patent is extended or adjusted under 35 U.S.C. 154(b) by 168 days.

(21) Appl. No.: 14/003,773

(22) PCT Filed: Mar. 8, 2012

(86) PCT No.: PCT/IB2012/051087

§ 371 (c)(1),
(2), (4) Date: Sep. 6, 2013

(87) PCT Pub. No.: WO2012/120468

PCT Pub. Date: Sep. 13, 2012

(65) Prior Publication Data

US 2013/0345025 A1 Dec. 26, 2013

(30) Foreign Application Priority Data

Mar. 8, 2011 (GB) ..... 1103918

(51) Int. Cl.
*A63B 24/00* (2006.01)
*A61H 1/02* (2006.01)
(Continued)

(52) U.S. Cl.
CPC ..... *A63B 24/0087* (2013.01); *A61H 1/0214* (2013.01); *A63B 21/0058* (2013.01); *A63B 21/00178* (2013.01); *A63B 22/0005* (2015.10); *A63B 22/0605* (2013.01); *A61H 2201/018* (2013.01); *A61H 2201/0192* (2013.01); *A61H 2201/5007* (2013.01); *A61H 2201/5043* (2013.01); *A61H 2201/5061* (2013.01); *A61H 2201/5064* (2013.01); *A61H 2201/5071* (2013.01); *A61H 2201/5079* (2013.01);
(Continued)

(58) Field of Classification Search
CPC ..... A63B 24/0087; A63B 22/08; A63B 22/0605; A63B 22/001; A63B 21/1496; A63B 21/1465; A63B 21/005; A63B 21/0058; A63B 23/0476; A63B 23/0405; A63B 23/0423; A63B 22/06; A63B 2022/0611; A63B 2022/0623
See application file for complete search history.

(56) References Cited

U.S. PATENT DOCUMENTS 5,016,871 A * 5/1991 Dalebout et al. ..... 482/5
5,267,925 A 12/1993 Boyd
(Continued)

FOREIGN PATENT DOCUMENTS

EP 0 194 399 A1 9/1986
EP 0 667 603 A1 8/1995
(Continued)

OTHER PUBLICATIONS

International Search Report for PCT/IB2012/051087, dated Jul. 18, 2012, 4 pages.
(Continued)

*Primary Examiner* — Loan H Thanh
*Assistant Examiner* — Megan Anderson
(74) *Attorney, Agent, or Firm* — Klarquist Sparkman, LLP

(57) ABSTRACT

Exercise apparatus is provided, which includes pedals on which a user can exert loads in a first direction, and a motor that is configured to drive the pedals in the opposite direction and that is controlled to run at a predetermined speed, so that the loads from the user are exerted by using muscles eccentrically. The apparatus is configured such that the user's body is in a generally upright orientation when using the apparatus—preferably in a standing orientation, without using a seat.

22 Claims, 6 Drawing Sheets

(51) Int. Cl.

| | |
|---|---|
| ***A63B 21/00*** | (2006.01) |
| ***A63B 21/005*** | (2006.01) |
| ***A63B 22/06*** | (2006.01) |
| *A63B 21/22* | (2006.01) |
| *A63B 22/00* | (2006.01) |
| *A63B 71/00* | (2006.01) |
| *A63B 71/06* | (2006.01) |

(52) U.S. Cl.

CPC . *A61H2203/0406* (2013.01); *A61H 2203/0425* (2013.01); *A63B 21/225* (2013.01); *A63B 22/001* (2013.01); *A63B 2022/067* (2013.01); *A63B 2022/0647* (2013.01); *A63B 2071/0072* (2013.01); *A63B 2071/0652* (2013.01); *A63B 2220/34* (2013.01); *A63B 2220/54* (2013.01); *A63B 2220/58* (2013.01); *A63B 2220/89* (2013.01); *A63B 2225/50* (2013.01)

(56) References Cited

U.S. PATENT DOCUMENTS

| | | | | |
|---|---|---|---|---|
| 5,722,915 | A | 3/1998 | Reck | |
| 7,905,817 | B2 * | 3/2011 | Giannascoli et al. | 482/57 |
| 2001/0019985 | A1 | 9/2001 | Reck | |
| 2003/0125167 | A1 | 7/2003 | Copeland | |
| 2004/0106502 | A1 | 6/2004 | Sher | |
| 2006/0063644 | A1 * | 3/2006 | Yang | 482/4 |
| 2006/0199700 | A1 | 9/2006 | LaStayo et al. | |
| 2007/0202992 | A1 | 8/2007 | Grasshoff | |
| 2009/0111658 | A1 | 4/2009 | Juan | |
| 2009/0124461 | A1 | 5/2009 | Pinto | |
| 2012/0167709 | A1 * | 7/2012 | Chen et al. | 74/594.2 |

FOREIGN PATENT DOCUMENTS

| | | | |
|---|---|---|---|
| EP | 1 900 398 | A1 | 3/2008 |
| GB | 2 016 934 | A | 10/1979 |
| WO | WO 2010/093077 | A1 | 8/2010 |

OTHER PUBLICATIONS

International Preliminary Report on Patentability for PCT/IB2012/051087, dated Jun. 18, 2013, 13 pages.

* cited by examiner

EXERCISE APPARATUS

CROSS REFERENCE TO RELATED APPLICATIONS

This is the U.S. National Stage of International Application No. PCT/IB2012/051087, filed Mar. 8, 2012, which was published in English under PCT Article 21(2), which in turn claims the benefit of Great Britain Application No. 1103918.7, filed Mar. 8, 2011.

FIELD OF THE INVENTION

This invention relates to an exercise apparatus. More specifically, the invention relates to an exercise apparatus that provides a repetitive exercising cycle.

BACKGROUND TO THE INVENTION

Repetitive or cyclical exercise apparatuses are frequently used in strength and fitness training and conditioning, as well as in the rehabilitation of injuries and physiotherapy. Such apparatuses include, for example, stationary indoor bicycles, step climbing machines and elliptical movement machines, amongst others.

Muscles can be exercised in various ways. In isotonic exercises the muscle length changes as force is exerted by the muscle. Isotonic exercises can either involve concentric contraction, in which a muscle shortens as it exerts force, or eccentric action, in which a muscle lengthens as it absorbs a force. In eccentric action, instead of pulling a joint in the direction of the muscle contraction, the muscle works to slow down or decelerate the movement of the joint. Exercises such as lowering a heavy weight or doing squats typically involve eccentric muscle action.

Studies have indicated that exercise which includes eccentric muscle action can produce greater gains in strength than exercise involving concentric contractions alone. Other benefits of exercises involving eccentric muscle contractions have also been observed.

Most cyclical exercise apparatuses induce mostly concentric muscle contractions, although a number of exercise apparatuses have been produced that allow exercise with both eccentric and concentric muscle contractions. These apparatus typically include pedals that are operated by the user's legs or arms and a seat in which the user sits in a recumbent position. The apparatuses are often intended for rehabilitation after injury and consequently operate at low speeds and, even when operating at high speeds, provide inadequate performance enhancement for competitive sportsmen.

The present invention seeks to provide an improved exercise apparatus that addresses or ameliorates the shortfalls set out herein above.

SUMMARY OF THE INVENTION

According to a first aspect of the present invention there is provided an exercise apparatus, said apparatus comprising:

a support structure;

at least one, but preferably two pedals, that is engaegeable by a person to receive a load from said person in a first direction, each pedal being moveably attached to the support structure and being configured to move relative to the support structure in a cycle; and a motor that is configured to drive the pedal in its cycle in a second direction that is opposite from said first direction, and wherein the apparatus includes a power controller that is configured to control the motor to run at a predetermined speed in the second direction.

wherein said pedal is attached to the support structure and said support structure is configured such that, when a foot of the person engages the pedal, the person's body is in a generally upright orientation such that the weight of the person can be predominantly borne by said pedal, i.e. the person can stand on the pedal or pedals while using the apparatus, although this does not rule out configurations where the person can be seated in an upright (not a reclined) orientation.

The "load" exerted by the person may be a force or a moment or the like and practically always results in a torque, but the more general word "load" is used to include force, moment, torque, or the like.

The apparatus may be configured so that the pedal can selectively receive said load from the person in said first direction or said second direction and the motor may be configured to drive the pedal in said cycle in the first direction or the second direction—irrespective of the direction in which the load is applied by the person on the pedals. Accordingly, the pedals can rotate in either direction and can be used for concentric or eccentric training.

The exercise apparatus may includes two of said pedals and the controller may be configured to control the motor to vary the torque exerted by the motor during a movement cycle of the pedals, so that the torque exerted by the person's legs on the two pedals can vary and/or so that the person can exercise with a combination of concentric and eccentric muscle contraction.

The pedal may be attached to the support structure by a crank arm, e.g. the exercise apparatus may be a stationary bicycle, and the crank length of the crank arm may be adjustable—preferably by automated means, while the crank arm is rotating. This accommodates persons with limited movement ability to use the machine. The user may also prefer an extended (longer) crank arm in order to generate a higher torque.

The apparatus may include a seat and the position of seat may be adjustable by automated means, while the apparatus is in use.

The apparatus may include a user interface that is configured for entering the predetermine speed of the motor. The display interface may also allow input of the desired exercise time as well as the weight, age or other biometric information of a user. The apparatus may make provision for a user to make a selection from different training routines, such as "rehabilitation", "high performance", "endurance" etc.

The motor and power controller may be configured to limit torque exerted by the motor to drive the pedal in the second direction, to a predetermined maximum torque and the user interface may be configured for entering the predetermined maximum torque.

The motor may be an AC servo motor and the torque exerted by the motor to drive the pedal in its cycle in the second direction, may be limited by limiting the current supplied to the motor.

The load exerted by the person in the first direction may be monitored by monitoring current input to the motor. Instead or in addition, the load may be measured by one or more strain gauges on said pedal.

The exercise apparatus may include a display for the load exerted by the person in the first direction and/or for the speed of rotation of the pedals in the second direction. The apparatus may include an electronic storage medium for recording the load exerted by the person in the first direction and/or other data and after completion of an exercise routine, the data may be transferred to an external device such as a removable storage medium or computer for post-processing and assessment.

The exercise apparatus may include one or more sensors that are configured to detect motion of the pedals and the apparatus may be configured to calculate the position of each pedal from its speed and to calculate the load exerted by the person on each pedal in the first direction, from the pedal's position and the torque in the motor.

The exercise apparatus may be a hybrid stationary bicycle wherein its support structure includes a first substructure for supporting handlebars and a second substructure for supporting said pedals, the first and second substructures being moveable by independent angular and telescopic adjustment to adjust the bodily orientation of the person.

The exercise apparatus may be an elliptical movement machine including two of the pedals in the form of foot rests, said foot rests being carried on rods which are pivotally connected to a mechanism for moving each of them cyclically in an upright plane.

According to another aspect of the present invention there is provided a kit for retrofitting an exercise apparatus to form an exercise apparatus as described herein above, the kit comprising a motor that is attachable to a support structure of the exercise apparatus to drive the pedal(s) of the apparatus in a cycle in the second direction that is opposite from the first direction of the load exerted on the pedal(s) by a person, the kit including a power controller that is configured to control the motor to run at a predetermined speed in said second direction. The kit may include any of the features described hereinabove.

BRIEF DESCRIPTION OF THE DRAWINGS

For a better understanding of the present invention, and to show how the same may be carried into effect, the invention will now be described by way of non-limiting example, with reference to the accompanying drawings in which.

DETAILED DESCRIPTION WITH REFERENCE TO THE DRAWINGS

Figure 1:
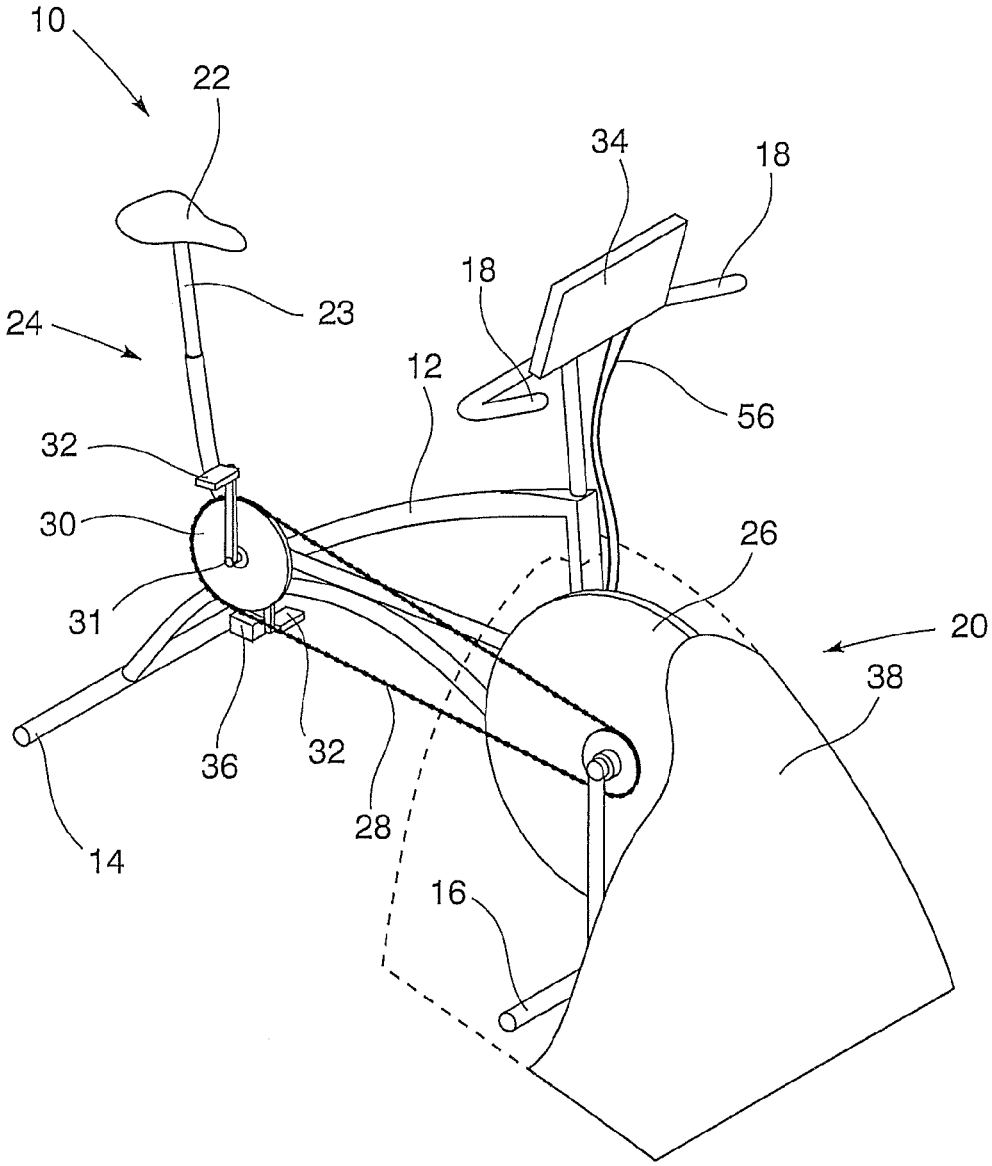
FIG. 1 is a perspective view of one embodiment of an exercise apparatus according to the invention.

FIG. 1 illustrates one embodiment of exercise apparatus in accordance with the invention in the form of a stationary indoor bicycle (10). The stationary bicycle (10) has a support structure in the form of a frame (12) with a pair of feet (14, 16) on which the frame rests. Handlebars (18) extend from the frame at a forward end (20) thereof and a seat in the form of a saddle (22) is fixed to a height-adjustable seat post (23) that extends from the frame (12) at a back end (24) thereof. Both the handlebars and the saddle are preferably adjustable both as regards height and position relative to the frame in a forward and rearward direction.

A flywheel (26) is rotatably supported by the frame (12) beneath the handlebars (18) and adjacent the forward end (20) of the frame (12) and is connected by a chain (28) to a crank sprocket (30). In the alternative, a timing belt and pulley may be used.

The crank sprocket (30) is mounted on an axle (31) which has one or preferably two grips and in the illustrated embodiment the grips are a pair of pedals (32). The pedals (32) can include toe clips for securing a user's foot (not shown) to the pedals.

A user interface or display interface controller (34) is mounted to the handlebars (18) in a position so as to be visible to the user. The display interface controller (34) will be more fully described below with reference to FIG. 3.

A pair of proximity sensors (36) is mounted to the frame (12) in a housing adjacent the pedals (32). The proximity sensors (36) are preferably magnetic sensors, such as electromagnets, that produce an electric signal when a pedal travels past the relevant sensor (36).

Figure 2:
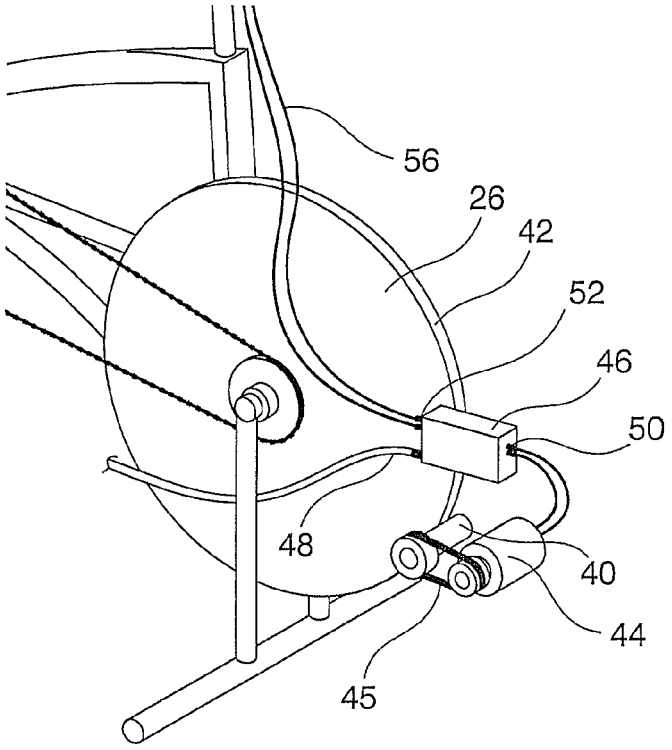
FIG. 2 is an oblique side view of the motor and power controller of the exercise apparatus illustrated in FIG. 1.

In the embodiment of the invention illustrated in FIG. 1, a plastic cowling (38) covers the flywheel (26) and also houses a motor and controller arrangement, which can be seen in FIG. 2.

FIG. 2 illustrates the forward end of this embodiment of stationary bicycle (10) with the cowling (38) removed. Inside the cowling, a roller (40) is mounted to press against the circumference (or rim (42)) of the flywheel (26). The roller (40) is connected to an electric motor (44) by a drive belt (45). The electric motor (44) is of the type known as an AC servomotor, driven by a motor power controller (46).

The power controller (46) includes a number of input and output ports. A mains supply cable (48) enters the power controller (46) and provides AC supply power to the power controller. A motor output port (50) is connected to the power controller and supplies regulated AC power to the motor (44). A communications port (52) on the power controller is connected by a cable (56) to the display interface controller (34).

The power controller (46) is encoded not only to control the rotational speed of the motor (44), but also to provide feedback to the interface controller (34) on rotational position and speed of the motor and to measure torque. The motor (44) selected is a constant power device and therefore the output torque of the motor will vary directly with the input current when the supply voltage is maintained at a given value. By maintaining voltage and limiting the current to a specific value, therefore, it is possible to limit the output torque of the motor to a predetermined value.

Figure 3:
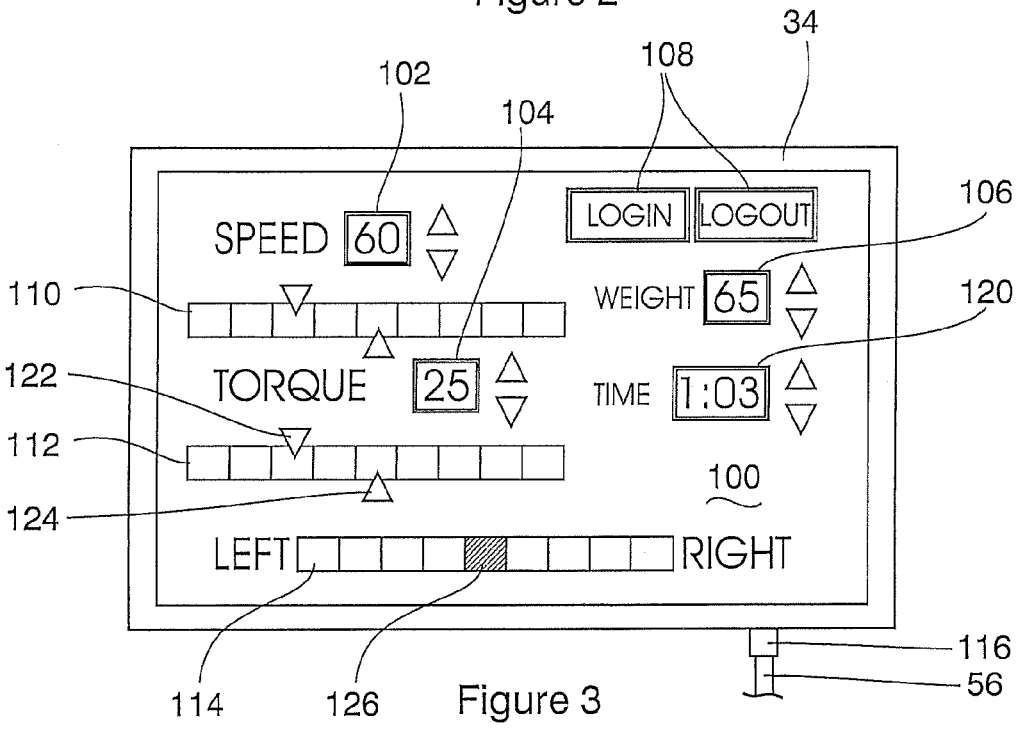
FIG. 3 is a front view of the display interface controller of the exercise apparatus illustrated in FIG. 1.

FIG. 3 illustrates the display interface controller (34) in more detail. The display interface controller includes a touch sensitive screen (100) on which a number of adjustable values are displayed. The adjustable values include a speed setting (102), a torque setting (104), a time setting (106) and login and logout buttons (108). The values of these fields can, in this embodiment of the invention, be adjusted by tapping on the appropriate arrows displayed adjacent the field. However, it will be appreciated that the display interface controller (34) shown in FIG. 3 is merely illustrative of one possible display configuration, and many other layouts or arrangements are possible.

The display interface controller (34) also includes an instantaneous speed display (110) and an instantaneous torque display (112). In this embodiment, the speed and torque displays (110, 112) include moving arrows that show the user how close the instantaneous speed and torque are to the selected speed and torque. Many other arrangements for displaying the instantaneous speed and torque are possible. For example, the actual instantaneous speed and torque values may be displayed next to the desired values (102, 104).

The display interface controller (34) also includes a left/right field (114) which indicates the torque applied to the left and right pedals, as will be further explained below. The display interface controller also includes its own onboard microprocessor for running software that provides the described functionality. In a preferred embodiment, the display interface controller has a high-speed graphics controller and a 32 bit RISC CPU processor that runs a Windows-based HMI software tool.

The display interface controller (34) includes a communications port (116) for communicating with the power controller (46) through the cable (56). Communication takes place in both directions between the display interface controller (34) and the power controller (46). The display interface controller communicates the selected speed and selected torque to the power controller and the power controller communicates the instantaneous speed and output torque to the display interface controller. Any appropriate communications interface between the power controller and the display interface controller can be used.

Based on the selected speed communicated to it by the display interface controller (34), the power controller (46) controls the speed of the motor (44) by varying the frequency of the regulated AC power supplied to the motor. The motor (44) thus rotates at a predetermined speed, which rotates the roller (40), flywheel (26) and pedals (32). During normal use, the power controller (46) controls the speed of the motor (44) to maintain its predetermined speed, irrespective of torque that may be exerted on it, but if an abnormally high torque is exerted on the motor that exceeds the maximum permitted torque entered on the interface controller (34), the power controller limits the current to the motor to a value which corresponds to the maximum allowed torque. The torque exerted by the motor (44) to rotate the flywheel (26), pedals (32), etc. will be minimal if no load is exerted on the pedals, but if a load is exerted on one or both of the pedals, the power controller (46) causes a torque to be exerted by the motor to counter the load from the pedals and thus maintain the predetermined speed. The torque exerted by the motor (44) is thus a direct indication of the load exerted on the pedals (32).

The motor (44) includes a sensor (not shown) which measures the instantaneous speed of rotation of the motor and communicates this to the power controller (46), which in turn communicates it to the display device (34) for display on the speed display (110). In an alternative embodiment, a sensor could be provided for detecting the speed of rotation of the flywheel (26) and the sensor could communicate directly with the display device (34), or the rotational speeds of the motor, roller and flywheel could be determined from the cadence of the pedals (32) from the proximity sensors (36).

The power controller (46) also communicates the instantaneous current supplied to the motor to the display device (34). As explained, the instantaneous current supplied to the motor is proportional to the instantaneous torque generated by the motor. The display device is therefore able to display the instantaneous torque on the display (112).

The display interface controller (34) also receives signals from the proximity sensors (36) by means of a wireless link, or other link such as a cable (not shown). By comparing the signals received from the proximity sensors (36) with the instantaneous torque in the motor (44), the microprocessor built into the display interface controller is able to calculate which pedal is experiencing a higher load. This relative torque is displayed by means of the left/right display (114) to enable a user thereof to monitor which leg is working hardest in an attempt to balance the loads on the two legs. Other methods of determining the load exerted on each pedal can be used, for example, by providing a pressure sensor on each pedal that communicates with the display interface controller.

In one embodiment of the invention, the display interface controller may enable the user to enter login details by means of the login button (108), and the display interface controller (34) may have a memory for recording the instantaneous torque and speed over time. In such a case, the display interface controller may include a printer output to enable a user record to be printed. The memory may also store the weight, height and other biometric information of the user so that this information is only entered once during a registration stage. Data from the exercise routine may be recorded to removable memory for post-processing and assessment.

In use, a user enters the relevant login information and, as may be required, biometric information on the touch sensitive screen (100) and relevant training routines, such as "rehabilitation", "high performance", "endurance" etc, as may be appropriate. The user then selects the desired speed and maximum torque limit settings by means of the fields (102, 104) on the touch sensitive screen and enters the duration for the workout by means of a time field (120). The selected values are displayed on the display screen, and the user will then push a start button (not shown). The display interface controller then communicates the speed and torque settings to the power controller (46), which spins the motor (44) up to the desired speed. The motor drives the roller (40) by means of the drive belt (45), which in turn, in this embodiment of the invention, drives the flywheel (26), which in turn rotates the pedals (32) by means of the chain (28).

As the pedals start turning, the user begins to resist the motion of the pedals by exerting a (crank fashion) load on the pedals in a direction opposite to the direction of rotation of the pedals. The instantaneous torque and speed are calculated by the display interface controller (34) and displayed on the speed display (110) and the torque display (112), and the relative torque applied to the left and right pedals is displayed on the left/right display (114).

As the user applies more resistance to the motion of the pedals, the torque display will indicate that the instantaneous torque is approaching the selected maximum torque limit (104). While such a display could be shown in many ways, in the illustrative embodiment shown in FIG. 3, the upper arrow (122) of the torque display (112) will move to the right as the instantaneous torque increases and approach the lower arrow (124). The user may attempt to maintain a certain torque during a certain stage of the workout and/or may attempt to keep the upper arrow as close as possible to the lower arrow to ensure that the instantaneous torque is close to the selected maximum torque limit (104). However, the purpose of entering the selected torque is primarily a safety feature, which prevents the motor (44) from exerting a torque that is so high that it may injure the user, e.g. if an inexperienced user's leg "locks" in resisting rotation.

During typical use, the user will monitor the left/right display (114) to ensure that roughly equal torque is being applied to the left and right pedals. The left/right display may have a moving bar (126) to indicate the relative pressure applied to the pedals, and the user will attempt to keep the moving bar centred. However, if a user needs to exercise one leg more than another or only needs to exercise one leg, the bicycle (10) would be used in the same manner, except that the user would attempt to keep the moving bar of the left/right display (114) to the left or right, as the case may be.

The power controller (46) will prevent the motor from spinning faster than the selected speed (102) and will prevent the motor from supplying more than the desired maximum torque (104). Therefore, if the user exerts more torque by force on the pedals (32) than the maximum selected torque (104), the motor (44) will slow down. In this way, it is even possible for a user to stop the pedals (32), by applying more resistance than the selected maximum torque. However, the objective is for the user to maintain a predetermined resistive torque, which may be a resistive torque that approaches the maximum selected torque (104), without slowing down the motor (44) too much. It has been found that such a balance is easily achieved after a user becomes accustomed to using the exercise apparatus (10).

By applying a resistive load against the rotation of the pedals (32), the user exercises the quadriceps muscles using primarily eccentric muscular contractions, rather than concentric contractions of conventional stationary bicycles.

The display interface controller (34) and power controller (46) may be programmed to provide various safety features. For example, based on the biometric information of the user (such as, for example, age and weight), the display interface controller is able to calculate a safe maximum torque and speed setting for that user, and will prevent higher torque and speed settings from being selected.

The apparatus (10) also has an easily accessible emergency stop for additional safety.

The invention therefore provides an exercise apparatus of familiar configuration that has a repetitive exercising cycle, and that induces primarily eccentric muscle action. Exercises using the exercise apparatus have been found to provide an easy and comfortable way for eccentric exercises to be accomplished.

The pedals (32) can be selected for rotation in either direction for eccentric exercise and if a user desires, he can exercise by exerting load in the same direction as rotation, i.e. the apparatus can also be used for concentric muscle action.

It will be understood that while the invention has been described with reference to a stationary indoor bicycle, the exercise apparatus of the invention could be any exercise apparatus that provides a repetitive exercising cycle.

Figure 4:
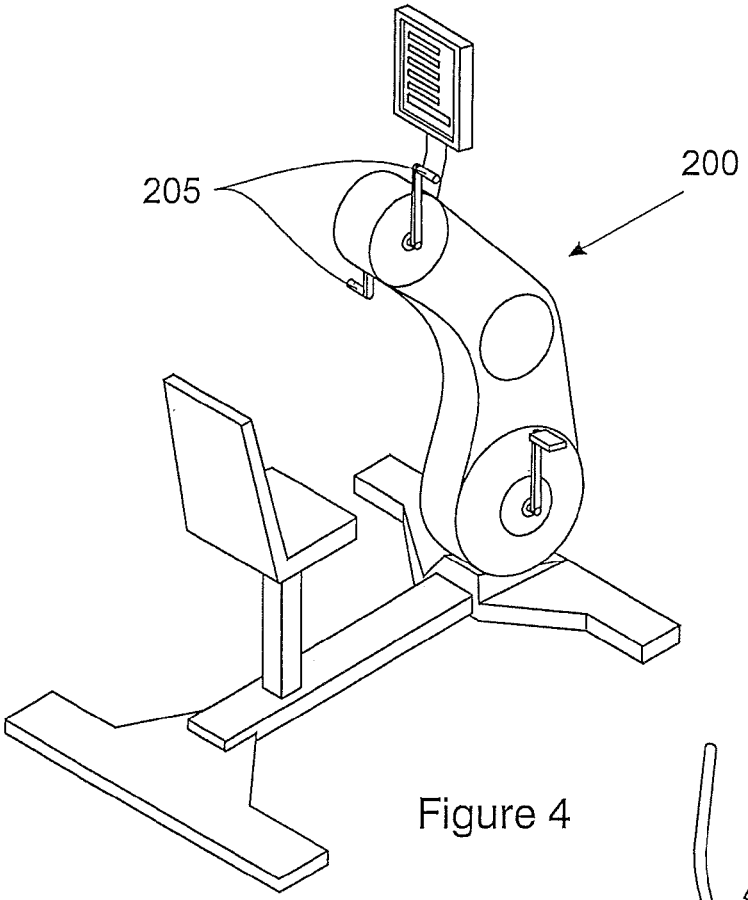
FIG. 4 is a perspective view of a second embodiment of an exercise apparatus according to the invention.

The exercise apparatus could, for example, be a rotating shoulder machine (200) as shown in FIG. 4. In FIG. 4, the grips are a pair of handles (205) that are rotated by a user in a sitting position. The handles (205) may be connected to a mechanism that may or may not include a flywheel inside the machine. The mechanism may be driven by a motor and controller arrangement in the same way as the stationary bicycle (10) shown in FIGS. 1 to 3.

Figure 5:
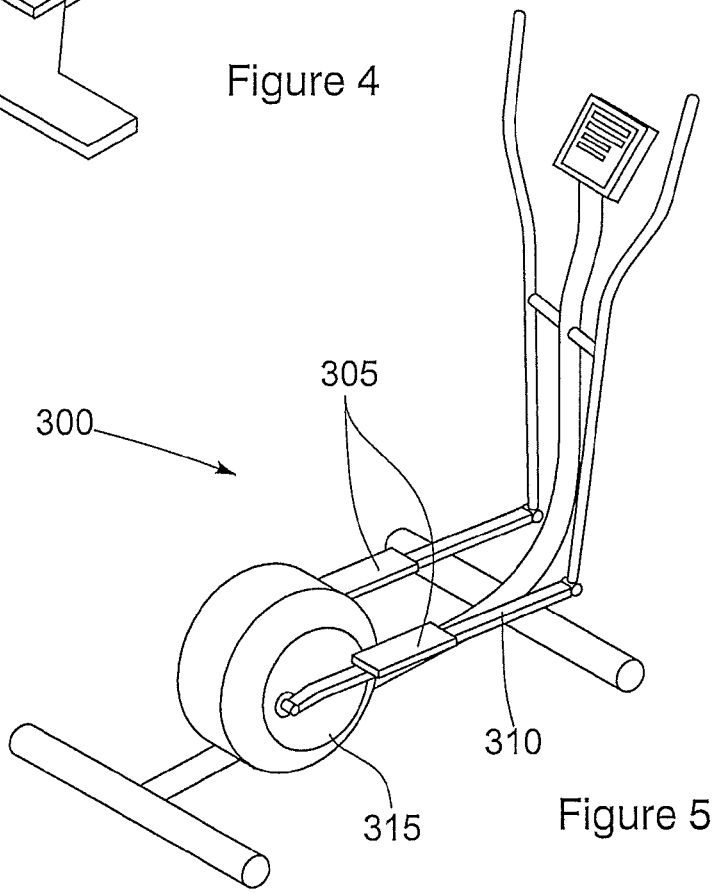
FIG. 5 is a perspective view of a third embodiment of an exercise apparatus according to the invention.

The exercise apparatus could also be an elliptical movement machine (300) as shown in FIG. 5. In FIG. 5, the grips or pedals are a pair of footrests (305) on which a user stands. The footrests (305) are carried on rods (310) which are pivotally mounted to a flywheel (315). The flywheel (315) is driven by a motor and controller arrangement in the same way as the flywheel of the stationary bicycle (10) shown in FIGS. 1 to 3.

Figure 6:
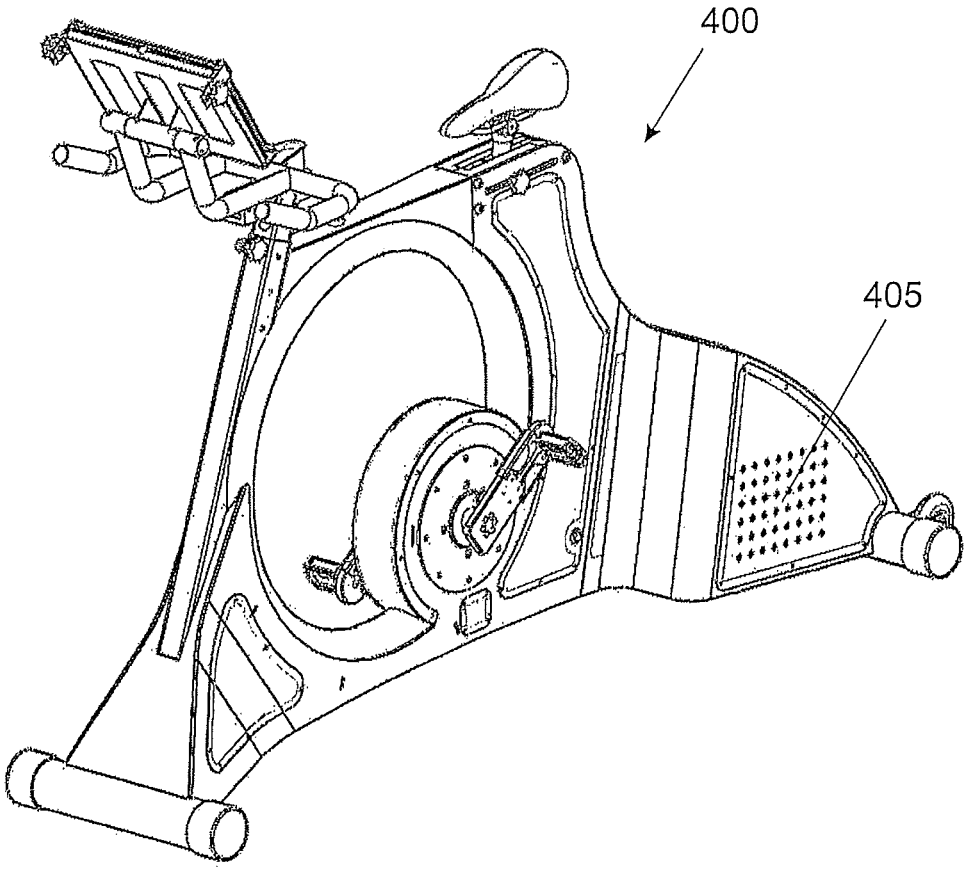
FIG. 6 is a schematic perspective view of a further embodiment of exercise apparatus according to the invention, in the form of a stationary bicycle.

FIG. 6 illustrates a further embodiment of stationary bicycle (400) according to the invention in which there is no flywheel and the entire motor and controller assembly is housed in a housing (405) at the rear of the bicycle.

Figure 7:
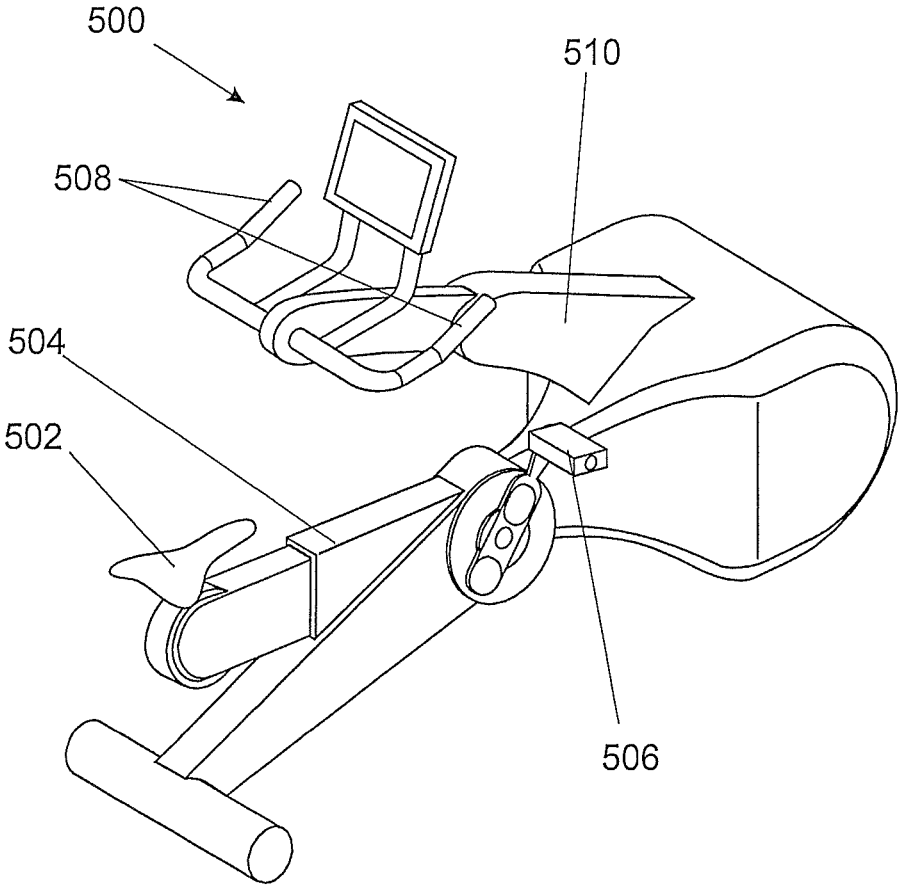
FIG. 7 is a schematic perspective view of a hybrid recumbent exercise apparatus according to the invention.
Figure 8:
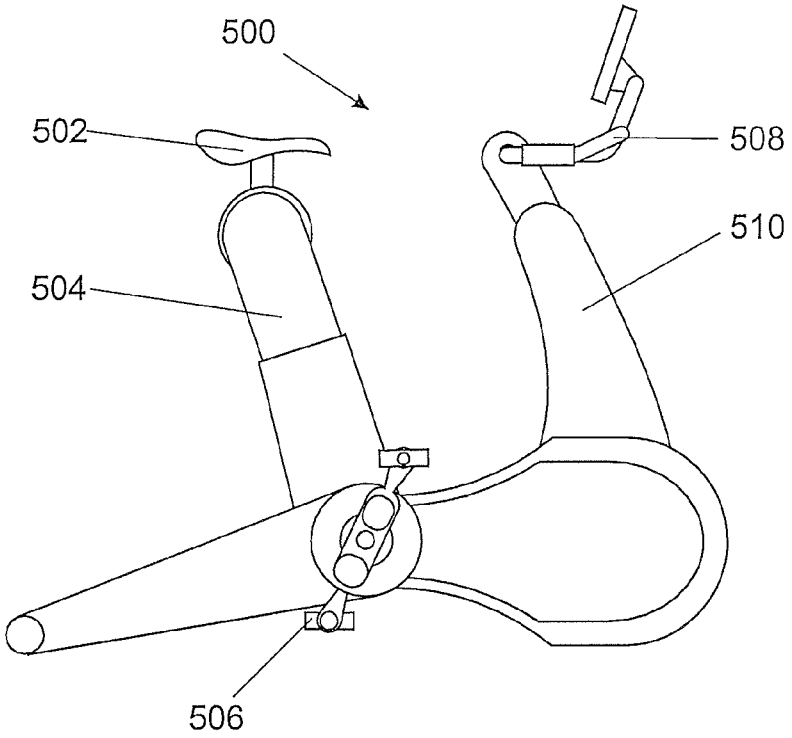
FIG. 8 is a side view of the apparatus illustrated in FIG. 7 in an upright condition; and, FIG. 9 is a side view of the apparatus illustrated in FIG. 7 in a recumbent condition.
Figure 9:
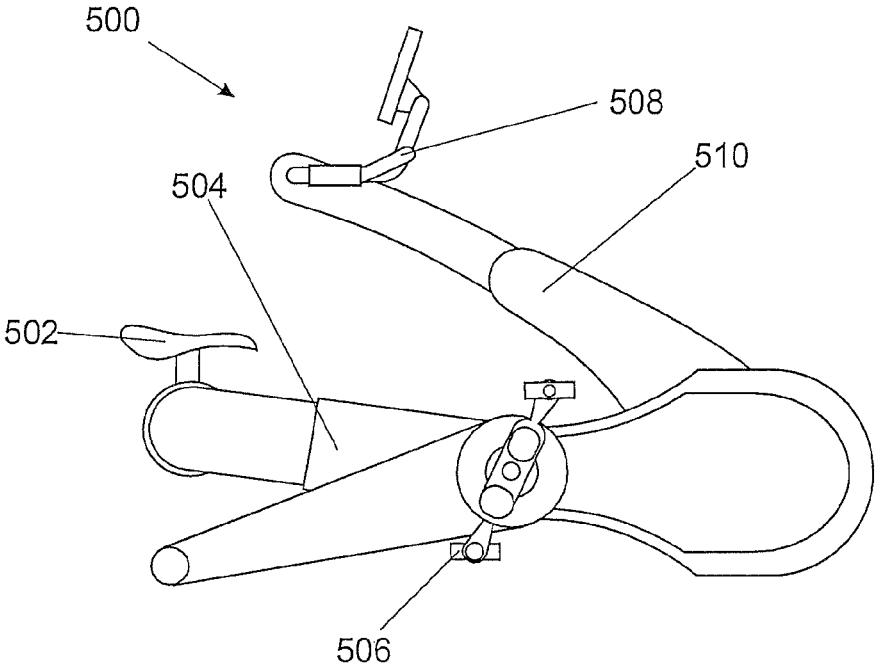

Referring now to FIGS. 7 to 9, another embodiment of an apparatus according to the invention is a hybrid recumbent exercise apparatus (500) of the stationary bicycle variety wherein the seat (502) is carried at one end of an angularly adjustable and telescopically adjustable rear beam (504) that is adjustable approximately about the axis of rotation of the pedals (506). The saddle can thus be adjusted between positions illustrated in FIG. 8 in which the seat is spaced upwardly from the pedals in a approximately conventional relationship thereto for a stationary bicycle for use by a user in a generally upright position and a very much lowered position in which the pedals are forward of the seat and generally at the same horizontal level for use by a user in a generally recumbent position, as illustrated in FIG. 9.

Similarly, the handle bars (508) are carried at the upper end of an angularly and telescopically adjustable forward beam (510) so that the handles can be adjusted to a comfortable position for a person sitting on the seat in either its upright or its recumbent position, as illustrated in FIG. 9.

It will be understood that the motor, power controller and display device could also be retrofitted to an appropriate type of existing repetitive exercise apparatus to provide a kit according to an embodiment of the invention. The elements of the kit may include any of the features described herein, and the kit may also include the sensors for detecting the instantaneous position of the grip. In his way, existing exercise apparatuses could be retrofitted to provide for eccentric muscular exercises.

Use of the various exercise apparatus described above has shown a remarkable increase in the effectiveness of the exercise between recumbent exercises (e.g. practiced on the apparatus (200) shown in FIG. 4) and upright seated exercise (e.g. practiced on the apparatus (10), (400) and (500) shown in FIGS. 1-3 and 6-9). There is a further remarkable increase in effectiveness of the exercise between upright seated exercise and upright standing exercise (e.g. practiced on the apparatus (300) shown in FIG. 5 or when the user exercises in a standing position using apparatus (10), (400) or (500) as shown in FIGS. 1-3, 6 and 8). Accordingly, in the preferred embodiments of the invention, the user remains in a standing position and the saddles (22) are not used or are removed from the exercise apparatus. The handlebars (18) assist the user in maintaining balance and preferably do not contribute significantly (or at all) in bearing the weight of the user or bearing forces or countering forces exerted on the pedals (32).

The remarkable increase in the effectiveness of exercise in unsupported upright orientations results from additional muscle action required, including:

a. Proprioception. The user is required to exercise fine muscle control in order to maintain his upright body position, while exercising.

b. Core strength: the user is required to use his core muscles to stabilise him and maintain his upright orientation, but also in using his body weight to counter his leg movement—which counter action would have been provided by the seat in a reclined exercise apparatus.

c. Lateral stability: The user uses his legs reciprocally, or if he is predominantly exercising one of them, he uses it cyclically and as a result, his body would tend to move laterally with each exercise cycle. This movement would be countered by the seat in a reclined exercise and would be countered in part by the seat in an upright seated exercise, but would not be countered at all during upright, unseated exercise. The lateral movement (insofar as it is not countered by a seat) needs to be countered by muscle action of the user.

To a large extent, using the exercise apparatus described above with the user in an upright position, preferably not seated, simulates running, in part, by including eccentric muscle action, proprioception, core muscle action, lateral stability, etc. without placing the strain on joints, that is associated with running. Running is known to be a remarkable form of exercise and when running, muscles are used in eccentric and concentric contractions, but substantial strain is placed on joints such as the knees and ankles by the high impact with which the forces are applied that are countered by eccentric muscle contraction. By contrast, no impact loads are exerted when using the exercise apparatus of the present invention, due to the cyclic nature of the motions.

The effectiveness of the present invention is further enhanced by the ability to set the apparatus (10) so that muscles are only used eccentrically, are used only concentrically, or if desired, a combination of eccentric and concentric muscle action can be used.

Further, in preferred embodiments of the invention, the lengths of the crank arms of the pedals (22) are adjustable, which allows the length of spatial leg movement to be changed (i.e. the stroke travelled by the feet is adjusted), allows the angular movement to be adjusted (i.e. the extent of hip and knee flexion can be adjusted), and allows the moment arm of the crank action in the pedals to be adjusted. These adjustments are preferably made without interrupting the exercise, by automated adjustment of the pedal stroke length and this allows seamless changes in the exercise, e.g. increasing forces required or increasing the length or angles of movement during an exercise, as required for specialised training or rehabilitation programmes.

Similarly, the heights and forwards/rearwards positions of the saddles on the exercise apparatus (including the reclining apparatus (200), can be made to be adjustable during the exercise, to adjust the reach and angular movement during the exercise.

The invention claimed is:

1. An exercise apparatus comprising:

a support structure;

at least one pedal that is moveably attached to the support structure to move relative to the support structure in a cycle, said at least one pedal being configured to receive a crank fashion load from a user to exert a torque by force on the at least one pedal, said crank fashion load being applied by eccentric muscle action;

a motor; and a power controller that is configured to control the motor;

said support structure being configured such that, when a foot of the user engages the at least one pedal, the user's body is in a generally upright orientation;

wherein said motor is configured to drive the at least one pedal in its cycle to rotate in a rotation direction, said controller is configured to control the motor to run at a predetermined speed, and the rotation direction in which the at least one pedal is configured to be rotated by the motor, is opposite from the direction in which the user exerts the crank fashion load and the torque on the at least one pedal, so that the load and torque applied by the user are resistive to rotation of the at least one pedal;

wherein said apparatus includes a user interface that is configured for entering the predetermined speed of the motor, said motor and power controller are configured to limit torque exerted by the motor to drive the at least one pedal in the rotation direction, to a predetermined maximum torque, said user interface is configured for entering the predetermined maximum torque; and said motor is an AC servo motor and the torque exerted by the motor to drive the at least one pedal in its cycle in a second direction, is limited by limiting the current supplied to the motor.

2. The exercise apparatus as claimed in claim 1, wherein said exercise apparatus includes two of said at least one pedals and the controller is configured to control the motor to vary the torque exerted by the motor during a movement cycle of the two pedals.

3. The exercise apparatus as claimed in claim 2, wherein said load exerted by the user in the direction opposite to the rotation direction is monitored by monitoring current input to the motor.

4. The exercise apparatus as claimed in claim 1, wherein said at least one pedal is attached to the support structure by a crank arm and the crank length of said crank arm is adjustable.

5. The exercise apparatus as claimed in claim 4, wherein said crank length is adjustable by automated means, while the crank arm is rotating.

6. The exercise apparatus as claimed in claim 1, wherein said rotation direction in which the motor is configured to drive the at least one pedal, is selected from opposing rotational orientations.

7. The exercise apparatus as claimed in claim 1, wherein said exercise apparatus includes a seat and the position of said seat is adjustable by automated means, while the exercise apparatus is in use.

8. The exercise apparatus as claimed in claim 1, wherein said load exerted by the user in the direction opposite to the rotation direction is monitored by monitoring current input to the motor.

9. The exercise apparatus as claimed in claim 1, wherein said exercise apparatus includes at least one sensor configured to detect motion of said at least one pedal, the exercise apparatus being configured to determine the position and speed of the at least one pedal and to calculate the load exerted by the user on the at least one pedal in the direction opposite to the rotation direction, from the at least one pedal's position and speed and the torque in the motor.

10. An exercise apparatus a support structure;

at least one pedal that is moveably attached to the support structure to move relative to the support structure in a cycle, said at least one pedal being configured to receive a crank fashion load from a user to exert a torque by force on the at least one pedal, said crank fashion load being applied by eccentric muscle action;

a motor; and a power controller that is configured to control the motor;

said support structure being configured such that, when a foot of the user engages the at least one pedal, the user's body is in a generally upright orientation;

wherein said motor is configured to drive the at least one pedal in its cycle to rotate in a rotation direction, said controller is configured to control the motor to run at a predetermined speed, and the rotation direction in which the at least one pedal is configured to be rotated by the motor, is opposite from the direction in which the user exerts the crank fashion load and the torque on the at least one pedal, so that the crank fashion load and the torque applied by the user are resistive to rotation of the at least one pedal wherein said motor is an AC servo motor and said crank fashion load exerted by the user in the direction opposite to the rotation direction is monitored by monitoring current input to the motor.

11. The exercise apparatus as claimed in claim 10, wherein said apparatus includes two of said at least one pedals and the controller is configured to control the motor to vary the torque exerted by the motor during a movement cycle of the two pedals.

12. The exercise apparatus as claimed in claim 11, wherein said motor and power controller are configured to limit the torque exerted by the motor to drive the at least one pedal in the rotation direction, to a predetermined maximum torque.

13. The exercise apparatus as claimed in claim 12, wherein the torque exerted by the motor to drive the at least one pedal in its cycle in a second direction, is limited by limiting a current supplied to the motor.

14. The exercise apparatus as claimed in claim 10, further including a user interface that is configured for entering the predetermined speed of the motor.

15. The exercise apparatus as claimed in claim 14, wherein said motor and power controller are configured to limit torque exerted by the motor to drive the at least one pedal in the rotation direction, to a predetermined maximum torque, and said user interface is configured for entering the predetermined maximum torque.

16. The exercise apparatus as claimed in claim 15, wherein the torque exerted by the motor to drive the at least one pedal in its cycle in a second direction, is limited by limiting the current supplied to the motor.

17. The exercise apparatus as claimed in claim 10, wherein said at least one pedal is attached to the support structure by a crank arm and a crank length of said crank arm is adjustable.

18. The exercise apparatus as claimed in claim 17, wherein said crank length is adjustable by automated means, while the crank arm is rotating.

19. The exercise apparatus as claimed in claim 10, wherein said rotation direction in which the motor is configured to drive the at least one pedal, is selected from opposing rotational orientations.

20. The exercise apparatus as claimed in claim 10, further including a seat and the position of said seat is adjustable by automated means, while the apparatus is in use.

21. The exercise apparatus as claimed in claim 10, wherein said motor and power controller are configured to limit torque exerted by the motor to drive the at least one pedal in the rotation direction, to a predetermined maximum torque.

22. The exercise apparatus as claimed in claim 10, wherein said apparatus includes at least one sensor configured to detect motion of said at least one pedal, the apparatus being configured to determine the position and speed of the at least one pedal and to calculate the load exerted by the user on the at least one pedal in the direction opposite to the rotation direction, from the at least one pedal's position and speed and the torque in the motor.

* * * * *